United States Patent [19]

Endres et al.

[11] Patent Number: 4,800,911

[45] Date of Patent: Jan. 31, 1989

[54] WALKER CARRIER

[76] Inventors: Kathleen O. Endres; James T. Endres, both of 2512 Palma Vista Ave., Las Vegas, Nev. 89121

[21] Appl. No.: 34,630

[22] Filed: Apr. 6, 1987

[51] Int. Cl.[4] ..... A61H 3/00

[52] U.S. Cl. ..... 135/67

[58] Field of Search ..... 135/65, 66, 67, 75, 135/85; 224/273, 271, 272, 42.42; 297/5, 6

[56] References Cited

U.S. PATENT DOCUMENTS

| | | | |
|---|---|---|---|
| 1,204,416 | 11/1916 | Doser | 224/273 |
| 1,387,597 | 8/1921 | Fetters | 224/273 |
| 1,394,224 | 10/1921 | Scott | 135/67 |
| 1,577,298 | 12/1924 | Roeller . | |
| 3,232,251 | 2/1966 | Hughes | 297/6 |
| 3,586,276 | 6/1971 | O'Mahoney | 248/128 |
| 3,945,389 | 3/1976 | Smith | 135/67 |
| 3,957,071 | 5/1976 | Kenner | 135/47 |
| 4,074,683 | 2/1978 | DiChiara | 135/67 |
| 4,184,618 | 1/1980 | Jones | 224/42.46 |
| 4,186,859 | 2/1980 | Frankfort et al. | 224/205 |
| 4,235,350 | 11/1980 | Valentino | 220/404 |
| 4,339,061 | 7/1982 | Dunn | 224/42.42 |
| 4,449,750 | 5/1984 | Pultman | 135/67 |
| 4,452,484 | 6/1984 | Pastor | 297/5 |
| 4,491,257 | 1/1985 | Ingles | 224/42.45 |

*Primary Examiner*—Robert A. Hafer
*Assistant Examiner*—Charles H. Sam
*Attorney, Agent, or Firm*—Jerry R. Seiler

[57] ABSTRACT

An improved container comprising a frame and a flexible receptacle secured thereto includes bracket or hook means for being secured substantially entirely within the space between opposite leg members in a walker.

9 Claims, 3 Drawing Sheets

WALKER CARRIER

BACKGROUND OF THE INVENTION

A number of trays and carriers have been proposed for walkers. Of course, the purpose of such devices is to assist the user of the walker in conveniently carrying articles on the walker itself without requiring the use of a purse, or the like, which normally must be carried over the shoulder or in the hand of the user. A number of such carrying devices have been proposed in U.S. Pat. Nos. 3,957,071, 4,074,683, 4,184,618 and 4,449,700. However, all of those proposed are secured on the front of the walker, away from the user and outside of the space between the walker legs, to the disadvantage of causing a substantial imbalance of the walker, even to the point where if there is significant weight in the articles placed in the carrier, the user may have trouble manipulating the walker. Moreover, with the weight so far out in front of the user, the walker becomes not only difficult to move between steps, but the weight imbalance may cause serious discomfort or even injury to the user's back, shoulder and arm muscles. The present device is intended to reduce, or eliminate such imbalance problems in a walker carrier apparatus.

SUMMARY OF THE INVENTION

The walker carrier of the present invention is designed to be removably secured in the walker space between the walker legs thereby improving weight distribution of the walker and carrier assembly. Two specific types of carrier frame designs are used, one for a rigid walker and one for a folding-type walker. A flexible carrier bag or pouch, preferably also having a cover, is secured to a rigid frame to create an attractive and convenient carrier device.

DETAILED DESCRIPTION OF THE INVENTION

Figure 1:
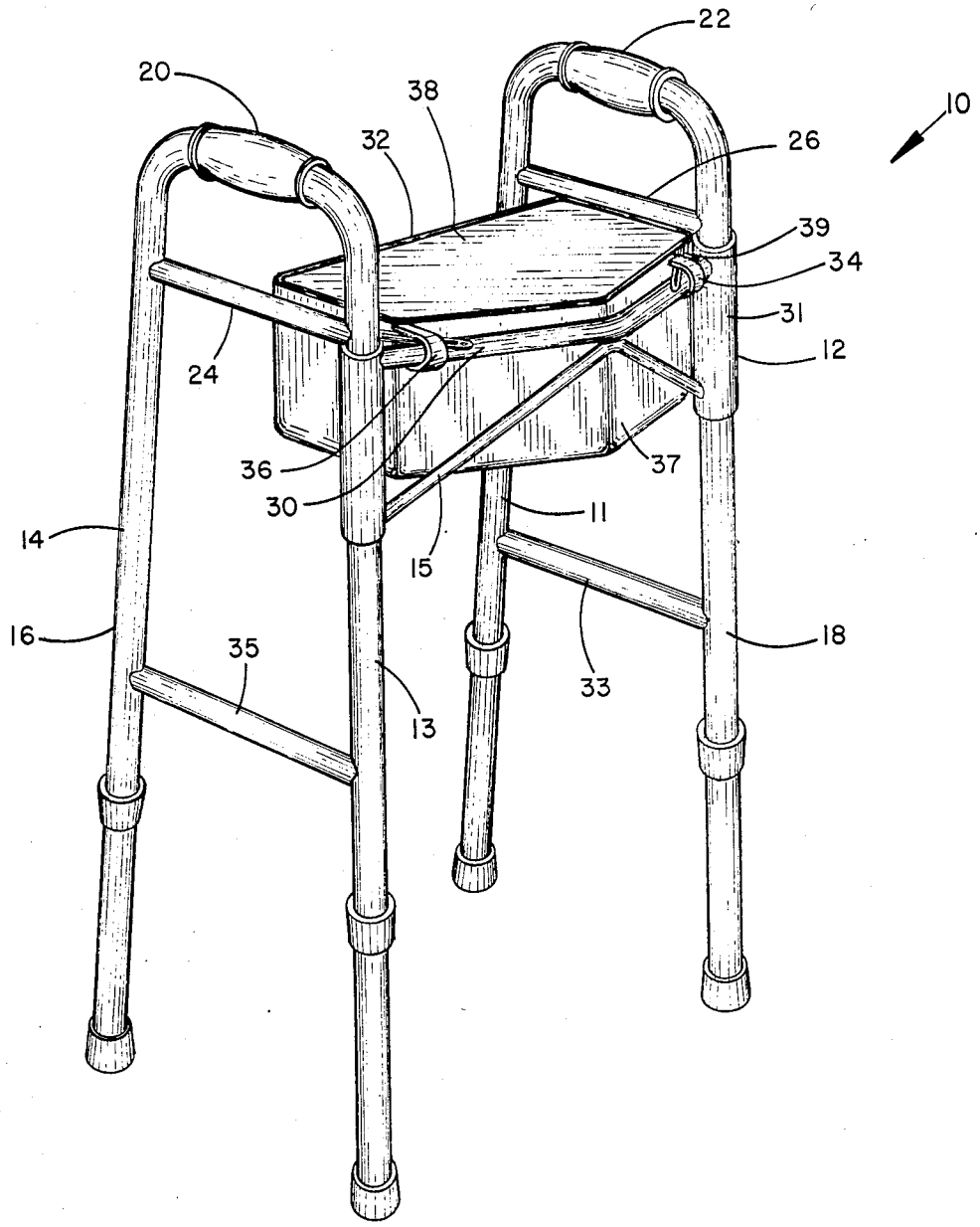
FIG. 1 is a perspective view of the front of a folding-type walker illustrating one embodiment of the carrier of the invention secured therein.

In FIG. 1 there is illustrated a first embodiment of the invention in which a carrier 10 is removably secured on a walker. The walker shown is of the folding-type so that it can be collapsed and more easily handled and stored when not in use, well known to those skilled in the art. The walker includes two opposite leg members 12 and 14 separated to form a space in which the user may position his or her body, especially when standing. It will be understood that the front of the walker viewed in FIG. 1 is closed with brace members 15 and 30 extending between the respective leg members to which they are secured for structurally stabilizing the walker. However, such braces are not present on the opposite back side of the walker so that it is open, so that the user can step into the space between the leg members. Each leg-member is composed of two legs, leg member 12 having a pair of legs 11 and 18 and leg member 14 comprising legs 13 and 16, respectively. The leg members themselves are also structurally supported by brace members, such members 24 and 35 secured to and extending between legs 13 and 16 and brace members 26 and 33 between legs 11 and 18. Brace members 15 and 30 are secured between two slidable sleeves 31 for supporting the walker in the open or folded position. Slotted brackets 39 secured between upper brace members 26 (24) and brace member 30 also assist to selectively support the walker in an open position. Handles 20 and 22 are located at the top ends of the pairs of legs, which handles normally have grips, as shown, so that the user may conveniently hold on to the handles for support when the walker is used.

Figure 5:
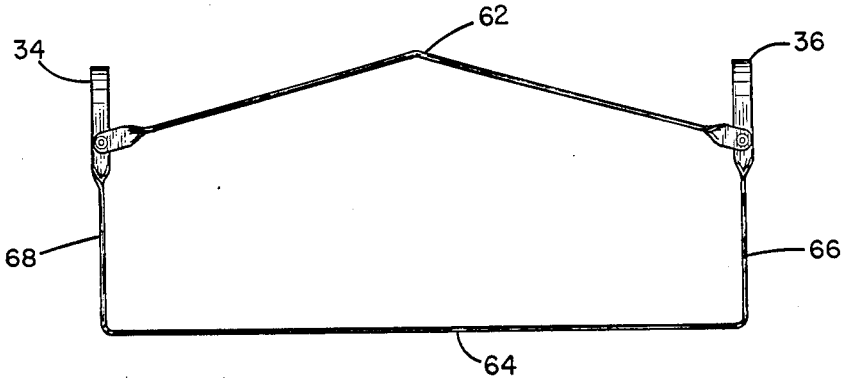
FIG. 5 is a top view of the carrier frame embodiment of FIG. 1.
Figure 6:
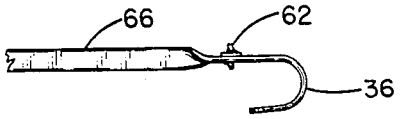
FIG. 6 is a side view of the frame of FIG. 5.

The carrier of the invention is removably secured in the space between the leg members 12 and 14. As illustrated in FIG. 1, the carrier comprises a receptacle 37, preferably made of a fabric or plastic material, which is flexible and somewhat soft to avoid sharp edges or corners which could cause discomfort or otherwise injure the user. Moreover, such materials are lightweight and relatively easy to work with in assembling the carrier. Referring also to FIGS. 5 and 6, a rigid frame includes a pair of hooks 34 and 36 for being secured over brace member 30 and slotted brackets 39 at the front of the walker. The frame to which the soft and flexible receptacle is secured is generally rectangular and includes a pair of shorter side frame members 66 and 68 and opposite longer frame members 62 and 64, these frame members being attached to each other at their adjacent ends. Receptacle 37 in being secured to such a frame has a front, back, sides and a bottom as illustrated, and preferably a cover 38 which is hinged along one of the longer side edges 32 so that the articles placed inside the container are well protected, as well as being hidden. Such a cover may be a separate piece or an extended portion of the front of the receptacle. The number of individual pieces of material used to form the receptacle is not critical.

Preferably, the width of the frame is such that it will extend substantially across the space between the leg members, and the depth of the carrier, which corresponds generally to the length of the shorter side frame members 66 and 68, will not take up all of the room in the space between the leg members. Thus, for example the width of the carrier may be between about 16" and about 18" whereas the length may suitably be between about 5" and about 8'. The depth of the receptacle itself is not critical and any convenient size of receptacle may be selected, normally between about 3–6" useful for most purposes. In the frame shown in FIG. 5, the shape of frame member 62 simply accommodates the additional space afforded by the shape of brace member 30. Otherwise a rectangular frame shape for the carrier is quite suitable. With the carrier embodiment shown in FIG. 1, 5, and 6, even though it is supported in the walker with only two hooks 34 and 36 secured on brace member 30, the carrier will also rest against brace member 15 so that it does not extend outside of the space between the leg members thereby affording the weight distribution advantage of the invention.

Figure 2:
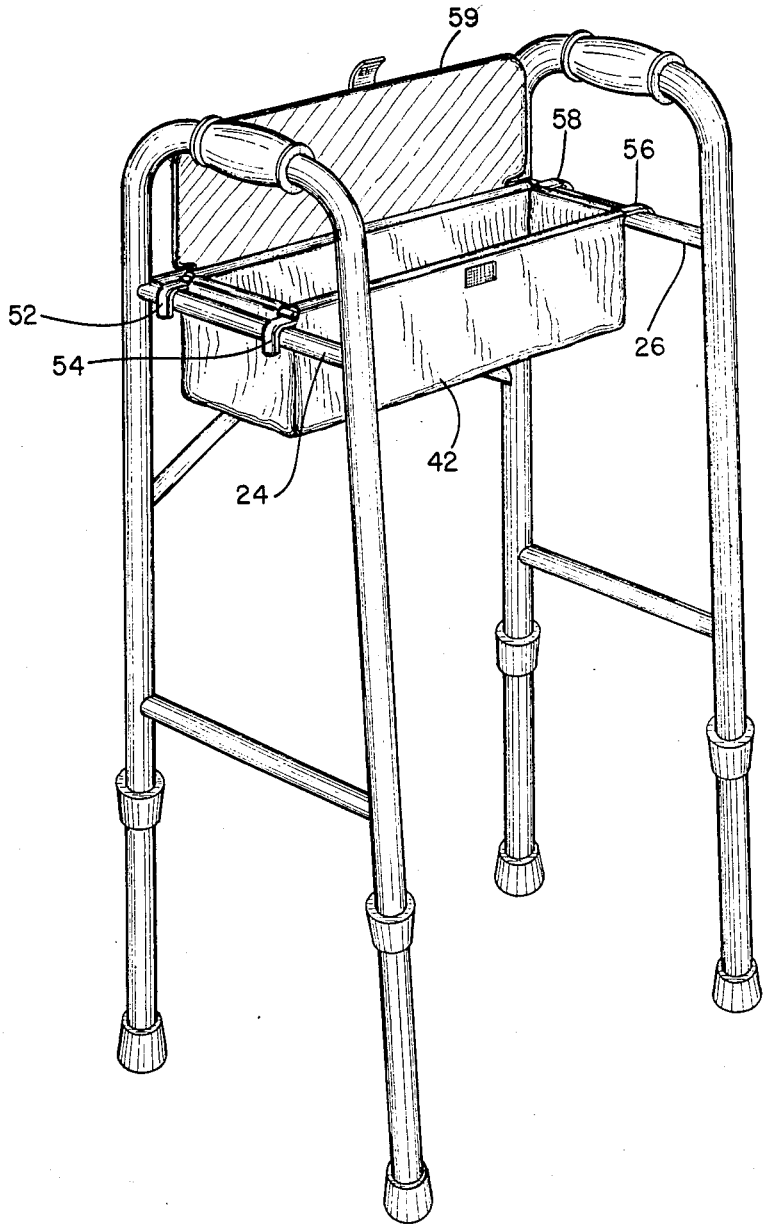
FIG. 2 is a rear perspective view of a rigid walker showing another embodiment of a carrier of the invention secured therein.
Figure 3:
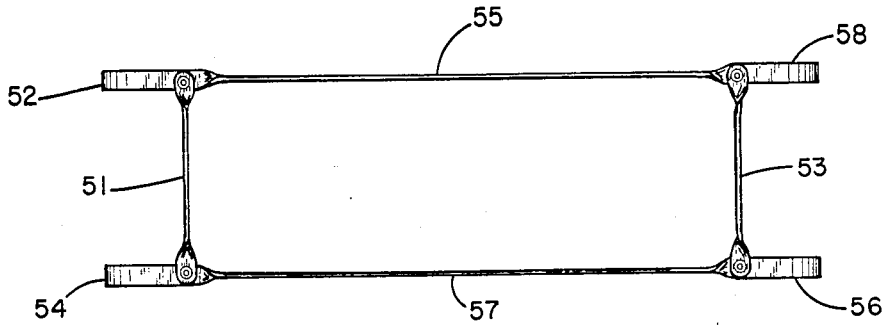
FIG. 3 is a top view of the frame of the carrier embodiment illustrated in FIG. 2.
Figure 4:
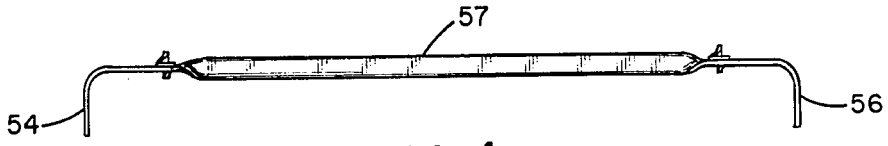
FIG. 4 is a side view of the frame of FIG. 3.

In FIG. 2 there is illustrated a second embodiment of the carrier of the invention utilized with a rigid walker, the figure being viewed from the back to show the full opening of the space between the leg members. In the walker of FIG. 2, brace members 15 and 30 which are at the back of the walker, are not hinged. The carrier and the frame which is shown in FIGS. 3 and 4, comprises a rectangular frame with opposite long frame members 55 and 57 to which are secured short frame members 51 and 53, again adjacent the ends thereof. At the ends of each of the elongated frame members 55 and 57 are hooks 52 and 58, and 54 and 56, respectively, which are preferably of the type illustrated in FIG. 4. Such hooks, rather than having a return, are right angle bends illustrated in FIG. 4. In this manner, the hooks of the frame can simply be placed over the two opposite brace members 24 and 26. The receptacle, other than any change of shape due to the shape of the frame is identical between the two embodiments shown, within the descriptions of materials and dimensions as set forth hereinabove. Again, the second embodiment illustrated in FIGS. 2–4 also is substantially entirely located within the space between the leg members, and does not extend outwardly therefrom to achieve the same advantage and efficiency of weight distribution. These as well as other features and embodiments within the scope of the invention disclosed herein will be evident to those skilled in the art.

We claim:

1. A walker assembly comprising two leg members, each of said leg members having a pair of legs whereby a space is defined within said walker by an area between said leg members, handle means bridging the upper ends of each of said pair of legs, respectively, first brace members extending between the two legs of each of said pair of legs, respectively, and adjacent said handle means, and a second brace member extending between two opposite legs of different pairs of legs, and a carrier secured on said walker substantially entirely within said space defined between said leg members comprising a rigid frame removably secured on at least one of said first and second brace members and a flexible receptacle secured to and extending below said rigid frame, whereby the portion of said carrier extending below said rigid frame is flexible.

2. The assembly of claim 1 wherein said frame is secured to said first brace members.

3. The assembly of claim 2 wherein said frame is rectangular and comprises two long frame members each having a pair of hook members at opposite ends thereof, a first pair of said hook members removably secured on a first one of said first brace members and a second pair of said hook members removably secured on a second one of said first brace members.

4. The assembly of claim 1 wherein said frame is secured to said second brace member.

5. The assembly of claim 4 wherein said frame comprises two opposite long frame members and two opposite short frame members and wherein said short frame members each have a hook at one end thereof removably secured on said second brace member.

6. The assembly of claim 3 wherein said flexible receptacle includes a bottom, four sides and a top and wherein the top edges of said sides are secured to said frame.

7. The assembly of claim 5 wherein said flexible receptacle includes a bottom, four sides and a top and wherein the top edges of said sides are secured to said frame.

8. The assembly of claim 6 wherein said top is hinged to open toward said space defined between said leg members.

9. The assembly of claim 7 wherein said top is hinged to open toward said space defined between said leg members.

* * * * *